US008474655B2

(12) United States Patent
Hackleman et al.

(10) Patent No.: US 8,474,655 B2
(45) Date of Patent: Jul. 2, 2013

(54) BAG-IN-BOX CONTAINER INCLUDING A PRE-POSITIONED, SECURED DISPENSING SPOUT

(75) Inventors: George N. Hackleman, Adair Village, OR (US); Benjamin Zoladz, Corvallis, OR (US); David M. Hagen, Corvallis, OR (US); Dave Merrill, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 242 days.

(21) Appl. No.: 12/945,448

(22) Filed: Nov. 12, 2010

(65) Prior Publication Data

US 2011/0056983 A1 Mar. 10, 2011

Related U.S. Application Data

(63) Continuation of application No. PCT/US2008/063387, filed on May 12, 2008.

(51) Int. Cl.
*B65D 35/56* (2006.01)

(52) U.S. Cl.
USPC ..... 222/105; 229/117.3

(58) Field of Classification Search
USPC ... 222/94, 100, 105, 106; 229/117.27–117.35
See application file for complete search history.

(56) References Cited

U.S. PATENT DOCUMENTS

| | | | | |
|---|---|---|---|---|
| 2,973,119 | A * | 2/1961 | Parker | 222/131 |
| 3,138,293 | A * | 6/1964 | Roak et al. | 222/105 |
| 4,696,840 | A | 9/1987 | McCullough et al. | |
| 5,406,320 | A | 4/1995 | Durst et al. | |
| 5,474,203 | A * | 12/1995 | Baker | 229/117.27 |
| 5,551,600 | A * | 9/1996 | Sasaki et al. | 222/81 |
| 6,120,132 | A | 9/2000 | Coiner et al. | |
| 6,126,045 | A | 10/2000 | Last | |
| 6,228,011 | B1 * | 5/2001 | Takemura et al. | 493/87 |
| 6,473,571 | B1 | 10/2002 | Wegman et al. | |
| 6,507,720 | B2 | 1/2003 | Kabumoto | |
| 6,591,077 | B2 | 7/2003 | Yanagisawa | |
| 6,637,623 | B2 * | 10/2003 | Muise et al. | 222/105 |
| 7,024,140 | B2 | 4/2006 | Masuda | |
| 7,104,423 | B2 | 9/2006 | Smith | |
| 7,209,687 | B2 | 4/2007 | Sudo | |

(Continued)

FOREIGN PATENT DOCUMENTS

| | | |
|---|---|---|
| EP | 0423374 | 4/1991 |
| EP | 0941854 | 9/1999 |
| JP | 07257645 | 10/1995 |
| WO | WO9742035 | 11/1997 |

OTHER PUBLICATIONS

PCT Written Opinion of the International Searching Authority for PCT/US2008/063387 dated Oct. 28, 2008.

European Search Report dated Jul. 5, 2012 for EP 08755295.

*Primary Examiner* — Lien Ngo

(57) ABSTRACT

In one embodiment, a bag-in-box container includes a fluid containment bag including a pliable body and a dispensing spout that extends from the body, the spout including a neck and a collar that extends outward from the neck, a carton in which the bag is positioned, the spout of the bag being recessed within an interior space of the carton, and a locking member placed in contact with the neck that secures the spout in a predetermined position within the carton interior space.

22 Claims, 4 Drawing Sheets

U.S. PATENT DOCUMENTS

| | | | | |
|---|---|---|---|---|
| 7,356,290 | B2 | 4/2008 | Matsumoto | |
| 7,681,783 | B2 * | 3/2010 | Stephenson | 229/117.3 |
| 2003/0007040 | A1 | 1/2003 | Love | |
| 2005/0180782 | A1 | 8/2005 | Matsumoto | |
| 2006/0071021 | A1 | 4/2006 | Steeves et al. | |
| 2006/0092244 | A1 | 5/2006 | Nakajima | |
| 2006/0113319 | A1 | 6/2006 | Smith | |
| 2006/0175385 | A1 * | 8/2006 | McDowell | 229/117.32 |
| 2006/0197813 | A1 | 9/2006 | Ikezaki | |
| 2006/0243783 | A1 * | 11/2006 | Spivey et al. | 229/117.3 |
| 2007/0223972 | A1 | 9/2007 | Isomura | |

* cited by examiner

BAG-IN-BOX CONTAINER INCLUDING A PRE-POSITIONED, SECURED DISPENSING SPOUT

CROSS-REFERENCE TO RELATED PATENT APPLICATIONS

The present application is a continuation of co-pending PCT/US2008/063387 filed on May 12, 2008 by George N. Hackleman, Benjamin Zoladz, David M. Hagen and Dave Merrill and entitled BAG-IN-BOX CONTAINER INCLUDING A PRE-POSITIONED, SECURED DISPENSING SPOUT, the full disclosure of which is hereby incorporated by reference

BACKGROUND

Ink is often supplied to large scale printers using plastic containers. For example, the printer may comprise a rack upon which one or more cylindrical plastic ink bottles can be supported.

BRIEF DESCRIPTION OF THE DRAWINGS

The disclosed container can be better understood with reference to the following drawings. The components in the drawings are not necessarily to scale.

DETAILED DESCRIPTION

Disclosed herein are bag-in-box containers that include a pre-positioned, secured dispensing spout. In some embodiments, a bag-in-box container comprises a fluid containment bag having an integrated dispensing spout, a carton in which the bag is disposed, and a support tray and clip that together securely support the dispensing spout in a desired location within the container. In some embodiments, the bag-in-box container can be used to contain and supply ink for a printer.

Figure 1:
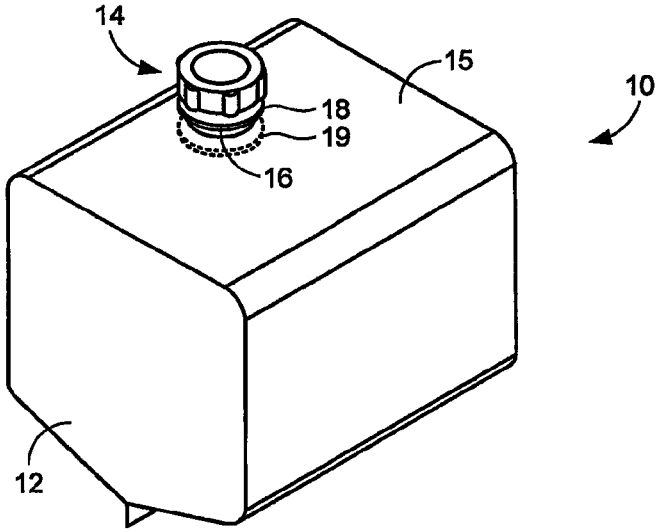
FIG. 1 is a perspective view of an embodiment of a fluid containment bag used to form a bag-in-box container.

Referring now in more detail to the drawings in which like numerals identify corresponding parts throughout the views, FIG. 1 illustrates a fluid containment bag 10 used to construct a bag-in-box container (see FIGS. 5A-5G below). As shown in FIG. 1, the bag 10 comprises a generally box-shaped bag body 12 that is adapted to hold a liquid, such as printer ink. The body 12 is constructed of a flexible, pliable material, such as a laminated plastic material. Due to the pliability of the body 12, the body can collapse as liquid is dispensed from the bag 10.

As is also shown in FIG. 1, the fluid containment bag 10 further comprises a dispensing spout 14 that is integrated with the bag body 12 and that extends upward from a top surface 15 of the body. As indicated in the figure, the dispensing spout 14 is offset from the center of the top surface 15 so as to be positioned adjacent a particular side of the body 12. The dispensing spout 14 is sized and configured to couple with a connector of a supply tube (not shown), such as a printer supply tube. The dispensing spout 14 is generally cylindrical and is formed of a rigid material, such as a rigid plastic, so to facilitate secure coupling of the supply tube connector. Provided along a neck 16 of the spout 14 is an outwardly extending external flange or collar 18 that is positioned outside of the bag body 12 and an outwardly extending internal flange or collar 19 that is positioned within the bag body. As described below, the collars 18, 19 together facilitate securing of the spout 14 in a predetermined position within the bag-in-box container.

Figure 2:
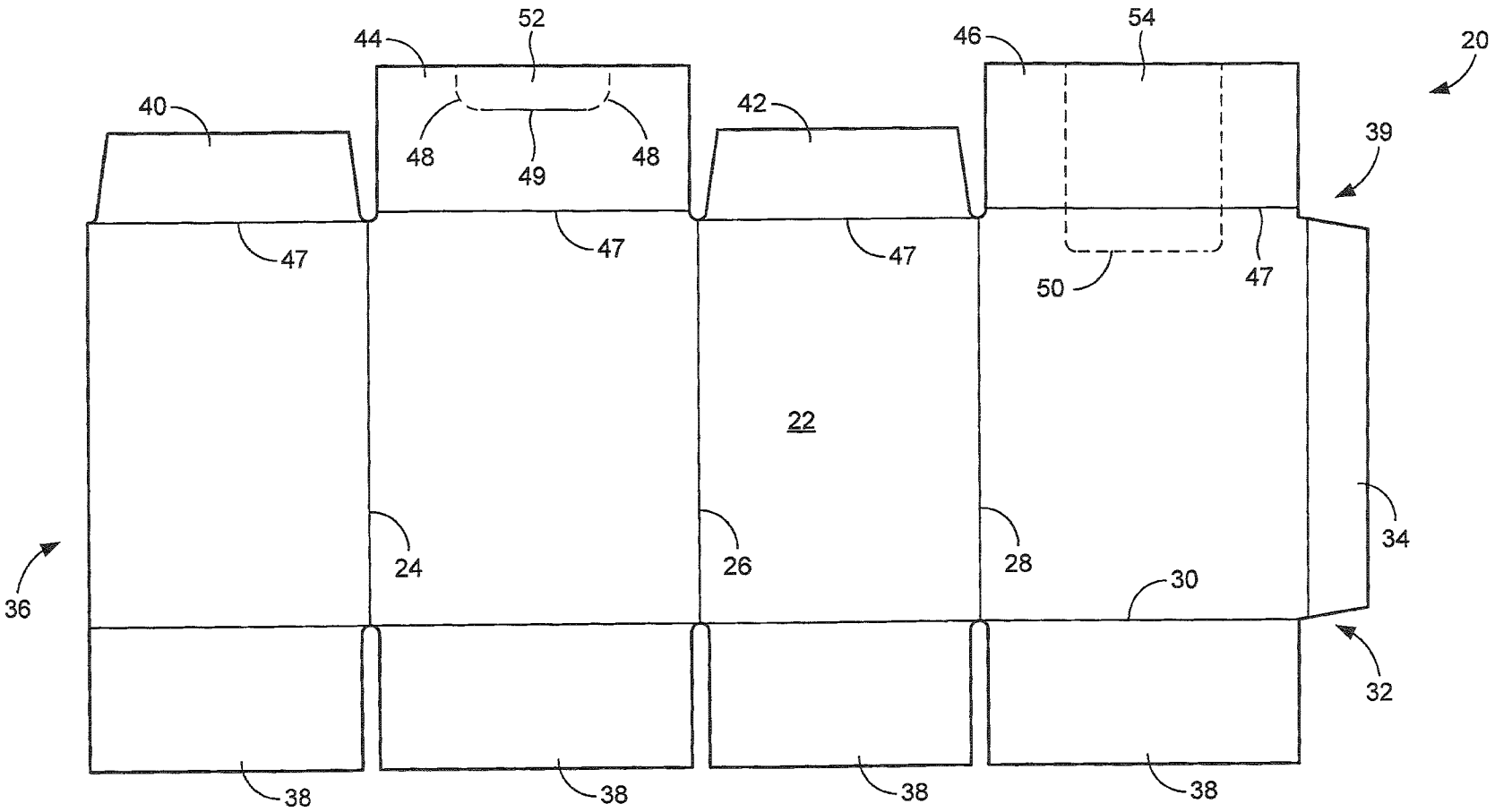
FIG. 2 is a plan view of a carton panel used to form a carton of the bag-in-box container.

Turning to FIG. 2, illustrated is a carton panel 20 that is used to form a carton or box of the bag-in-box container. In some embodiments, the panel 20 is formed from a sheet of corrugated fiberboard, commonly referred to as "cardboard." By way of example, the panel 20 is approximately 3/16 inches thick. The panel 20 comprises an elongated rectangular body 22 that comprises multiple fold lines 24, 26, and 28 along which the body can be folded to form the carton. Provided at one lateral edge 32 of the body 22 is a securing flap 34 that can be attached, for example using glue, to the opposite edge 36 of the body when the carton is constructed. Extending from a bottom edge 30 of the body 22 are base flaps 38 that are used to form the bottom of the carton. Once the securing flap 34 has been attached to the edge 36 of the carton, the base flaps 38 can be attached to each other, for example using glue, to form a carton having an open top (see carton 98 in FIG. 5C).

Extending from a top end 39 of the body 22 are first and second minor flaps 40 and 42, and first and second major flaps 44 and 46, each of which can be folded relative to the body along fold lines 47. As their names suggest, the minor flaps 40, 42 are smaller in size (i.e., length) than the major flaps 44, 46. As shown in FIG. 2, each major flap 44, 46 is provided with perforations that enable tearing of the panel 20. In the illustrated embodiment, the first major flap 44 comprises two independent perforation lines 48 and the second major flap 46 comprises a continuous perforation line 50. As described below, the perforation lines 48 enable a sub-flap 52 to be folded inward along fold line 49 into the carton to provide a handle for the bag-in-box container, while the perforation line 50 enables removal of a sub-panel 54 to provide access to the delivery spout 14 when the fluid containment bag 10 is disposed within the carton.

Figure 3:
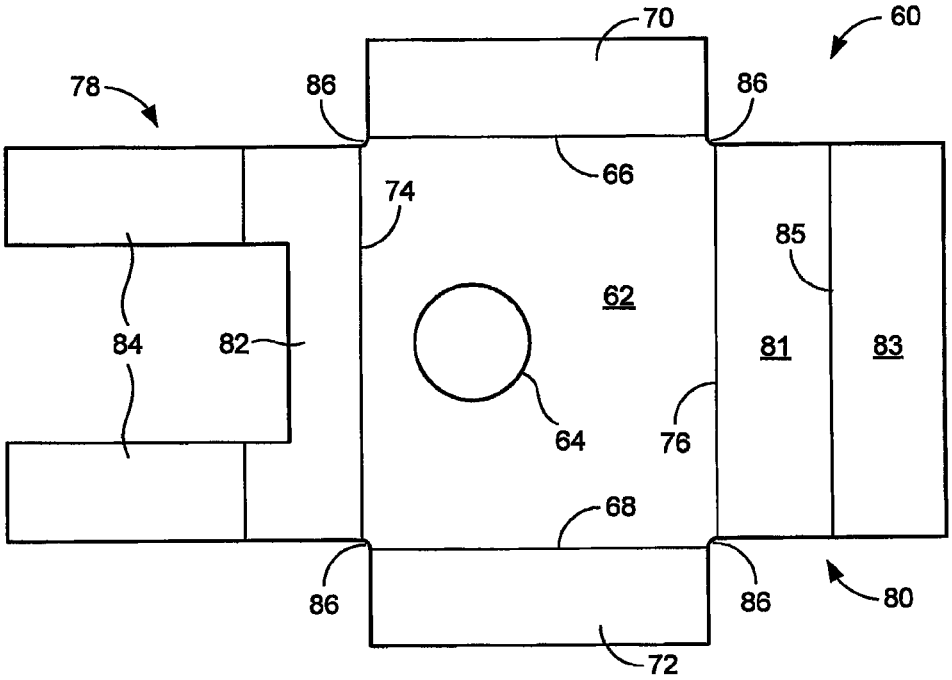
FIG. 3 is a plan view of a support tray used to form the bag-in-box container.

FIG. 3 is a plan view of a support tray 60, which is also used to form the bag-in-box container. In some embodiments, the tray 60 is, like the carton panel 20, formed from a sheet of corrugated fiberboard. By way of example, the support tray 60 is approximately 3/16 inches thick. The support tray 60 comprises a rectangular body 62 that forms the majority of the panel. Provided within the body 62 is a circular opening 64 that is sized and positioned to enable passage of the dispensing spout 14 when the bag-in-box container is constructed. The opening 64 is offset in similar manner as the spout 14 such that the opening aligns with the spout during such construction.

Extending from opposed first and second edges 66 and 68 (which define fold lines) of the body 62 are first and second minor flaps 70 and 72. Extending from opposed third and fourth edges 74 and 76 (which also define fold lines) of the body 62 are first and second major flaps 78 and 80. Again, the minor flaps 70, 72 are smaller in size (i.e., length) than the major flaps 78, 80. As shown in FIG. 3, the first major flap 78 comprises a base portion 82 and elongated arms 84 that extend from lateral edges of the base portion, while the second major flap 80 comprises first and second portions 81 and 83 (separated by a fold line 85) that together form a rectangle. As is further shown in FIG. 3, the flaps 70, 72, 78, and 80 together define four rounded corners 86 of the support tray 60.

Figure 4:
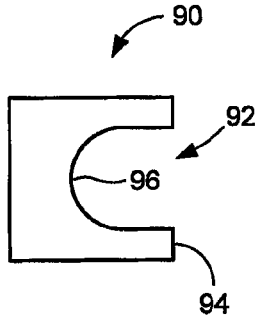
FIG. 4 is a plan view of a locking member used to form the bag-in-box container.

FIG. 4 is a plan view of a locking member 90 used to lock the bag dispensing spout 14 in a desired location within the bag-in-box container. The locking member 90 can be formed from a sheet of polymeric material, such as a sheet of corrugated polypropylene or a sheet of high-density polyethylene. By way of example, the locking member 90 is approximately ⅛ inches thick. As shown in FIG. 4, the locking member 90 is generally rectangular except for a notch 92 provided along an edge 94 of the member. As described below, the notch 92 is sized and configured to receive the neck 16 of the dispensing spout 14 to enable seating of the locking member 90 on top of the support tray 60 and below the external collar 18 of the spout 14. The notch 92 includes a rounded surface 96 that has a radius of curvature slightly larger than the outer radius of curvature of the neck 16 of the spout 14. The rounded surface 96 ensures that the spout 14 can be securely held in place by the support tray 60 and locking member 90.

Construction of a bag-in-box container using the components illustrated in FIGS. 1-4 is described in the following with reference to FIGS. 5A-5G. Beginning with FIG. 5A, the support tray 60 is applied to the fluid containment bag 10. In particular, the support tray 60 is placed on top of the top surface 15 of the filled bag 10 with the dispensing spout 14 of the bag extending through the opening 64 provided within in the body 62 of the tray. Next, with reference to FIG. 5B, the locking member 90 is slid between the external collar 18 of the spout 14 and the top surface of the tray 60. In particular, the locking member 90 is positioned such that the rounded surface 96 of the notch 92 abuts the neck 16 of the spout. Once in that position, the locking member 90 and as well as the tray 60 are positioned between the two collars 18, 19 of the spout 14.

Figure 5A:
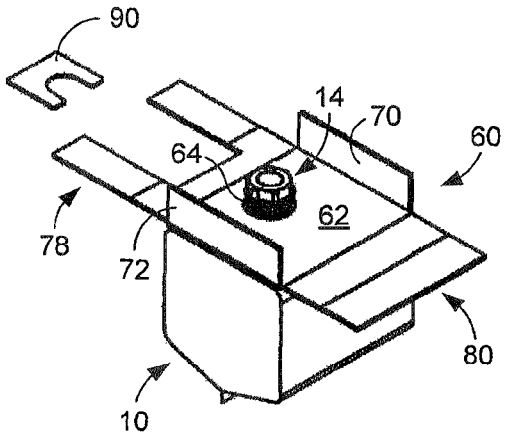
FIGS. 5A-5G are perspective views illustrating various stages of construction of the bag-in-box container.
Figure 5B:
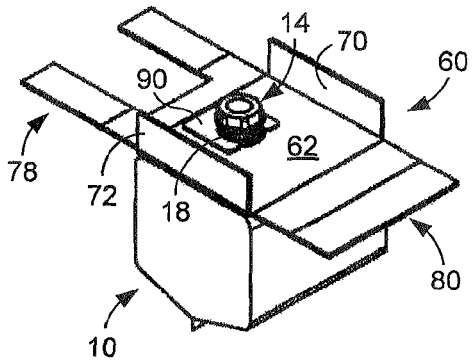
Figure 5C:
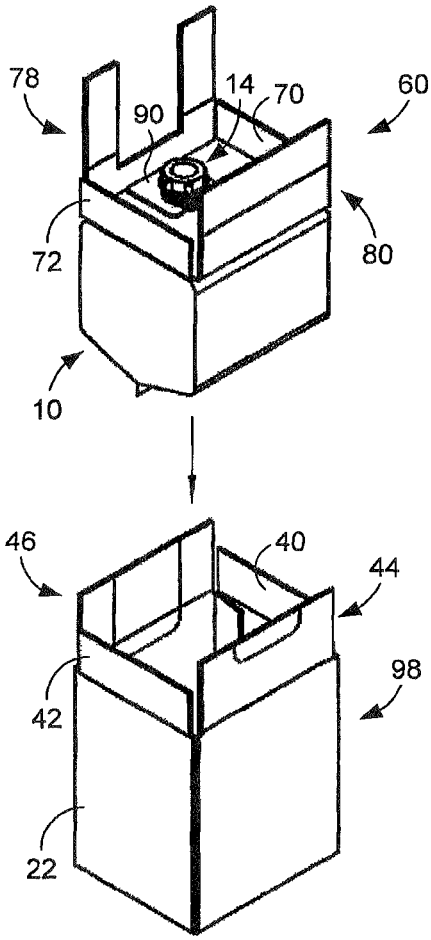

Referring next to FIG. 5C, each of the flaps 70, 72, 78, and 80 of the support tray 60 are folded upward along the edges (fold lines) 66, 68, 74, and 76 of the tray body 62 such that each flap forms an approximately 90 degree angle with the tray body. When the first major flap 78 is placed in that orientation, the locking member 90 is urged into contact with the bag dispensing spout 14. Because the locking member 90 and the support tray 60 are positioned or "sandwiched" between the spout collars 18, 19, the spout 14 is locked in place relative to the tray in the orientation shown in FIG. 5C. That orientation facilitates interfacing with the bag-in-box by the user. Therefore, the spout 14 is pre-positioned for use in dispensing a liquid, such as ink.

Figure 5D:
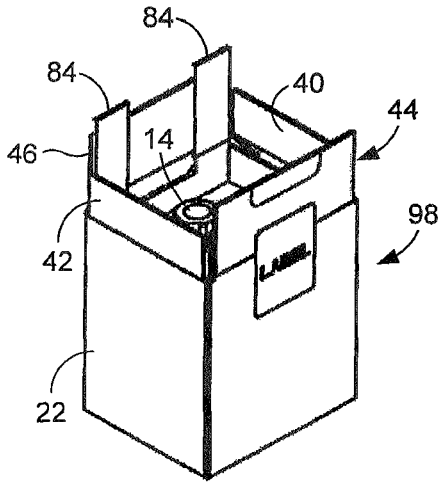

With further reference to FIG. 5C, the fluid dispensing bag 10, together with its attached support tray 60 and locking member 90, can be placed within a carton 98 that has been formed from the carton panel 20 described in relation to FIG. 2 above. FIG. 5D illustrates the carton 98 after the bag 10 has been placed inside the carton 98. As indicated in FIG. 5D, each of the flaps of the support tray 60 and each remaining flap of the carton 98 extend upward at this point.

Figure 5E:
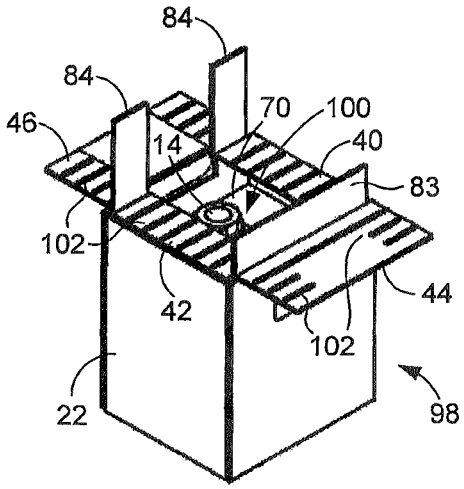

Turning next to FIG. 5E, the minor flaps 40 and 42 of the carton 98 are folded inward and the major flaps 44 and 46 of the carton are folded outward. As can be appreciated from FIG. 5E, the fluid dispensing spout 14 is now recessed within an interior space 100 of the carton 98 so that it is protected against damage that could otherwise be inflicted upon it during transit. As can also be appreciated from FIG. 5E, the support tray 60 completely overlies the bag body 12 so that the user cannot see or touch the bag body once the bag-in-box has been constructed.

Figure 5F:
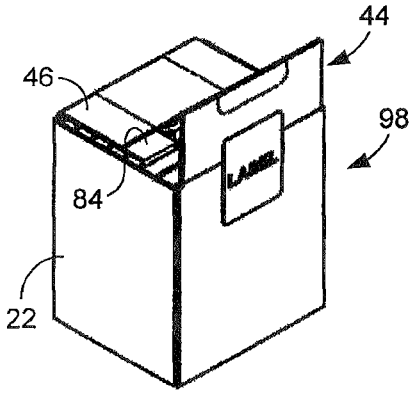

At this point, glue 102 is applied to the top surfaces of the flaps 40, 42, 44, and 46. Next, the arms 84 of the first major flap 78 of the support tray 60 are folded down onto the minor flaps 40 and 42 of the carton 98, and the second major flap 46 of the carton is folded down onto the arms, as indicated in FIG. 5F. Because of the glue 102 that had been applied to the flaps 40, 42, and 46, each of the arms 84 is now firmly attached to the second major flap 46 and one of the minor flaps 40 and 42, thereby providing substantial structural integrity and rigidity to the carton 98.

Figure 5G:
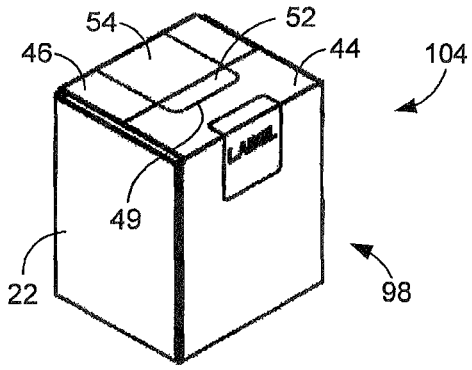

With reference next to FIG. 5G, the second portion 83 of the second major flap 80 of the support tray 60 is folded down onto the minor flaps 40 and 42 of the carton 98, and the first major flap 44 of the carton is folded down onto the second portion of the second major flap of the support tray, thereby forming a completed bag-in-box container 104. Because of the glue 102 that had been applied to the flaps 40, 42, and 44, the second major flap 80 is now firmly attached to the first major flap 44 and both minor flaps 40 and 42, which provides further structural integrity and rigidity to the carton 98.

Once construction of the bag-in-box container 104 has been completed, a user, such as the purchaser, may pop in the sub-flap 52 about the fold line 49 to form a "handle" (not shown) with which the container can be carried. When the user is prepared to use the container 104 to supply liquid, such as ink, the user can then remove the sub-panel 54 of the carton 98 to gain access to the interior space 100 and the dispensing spout 14, which has been secured in place within the carton by the support tray 60 and the locking member 90. Again, because of the orientation of the support tray 60 and the locking member 90 relative to the spout collars 18, 19, the spout 14 is firmly held in its predetermined position within the carton 98, thereby enabling convenient coupling of a delivery tube connector to the spout.

In the above disclosure, spatial terms, such as top, bottom, above, and below, are used to facilitate description of the disclosed inventions. It is to be understood that those terms refer to the inventions in the orientations shown in the figures only. Accordingly, such spatial terms may not apply when the inventions are placed in other orientations.

What is claimed is:

1. A bag-in-box container comprising:

a fluid containment bag including a pliable body and a dispensing spout that extends from the body, the spout including a neck and a collar that extends outward from the neck;

a carton in which the bag is positioned, the spout of the bag being recessed within an interior space of the carton; and a locking member placed in contact with the neck that secures the spout in a predetermined position within the carton interior space; and a support tray positioned adjacent the locking member, wherein the support tray comprises a body having an opening through which the dispensing spout extends, wherein the support tray comprises flaps that extend out from the body and wherein the flaps of the support tray are glued to flaps of the carton, wherein the flaps of the carton comprise minor and major flaps that extend from an end of the carton, the minor flaps being shorter than the major flaps, wherein the flaps of the support tray comprise minor and major flaps, the minor flaps being shorter than the major flaps and wherein the major flaps of the support tray are glued to and sandwiched between the minor and major flaps of the carton.

2. The container of claim 1, wherein the dispensing spout of the fluid containment bag comprises an external collar positioned outside of the bag body and an internal collar positioned within the bag body, wherein the locking member is positioned between the two collars.

3. The container of claim 1, wherein the dispensing spout is offset from a center of a surface of the bag body from which the spout extends.

4. The container of claim 1, wherein the carton is constructed of corrugated fiberboard.

5. The container of claim 1, wherein one of the major flaps of the carton comprises a removable sub-panel that enables a user to access the dispensing spout positioned within the interior space of the carton.

6. The container of claim 1, wherein one of the major flaps of the carton comprises a sub-flap that can be folded to provide a handle with which the container can be carried.

7. The container of claim 1, wherein the locking member is constructed of sheet of polymeric material.

8. The container of claim 1, wherein the locking member comprises a notch that is adapted to receive the neck of the dispensing spout adjacent its collar.

9. The container of claim 1, wherein the support tray is constructed of corrugated fiberboard.

10. A bag-in-box container for supplying ink to a printer, the container comprising:

a fluid containment bag including a pliable body and a dispensing spout that extends from the body, the spout including an external collar that extends outward from the neck outside of the body and an internal collar that extends outward from the neck inside of the body;

a carton in which the bag is positioned, the spout of the bag being recessed within an interior space of the carton, wherein the carton comprises minor and major flaps that extend from an end of the carton, the minor flaps being shorter than the major flaps;

a support tray positioned between the external and internal collars of the spout, the tray including a body having an opening through which the spout extends, wherein the support tray comprises minor and major flaps that extend out from the body, the minor flaps being shorter than the major flaps, wherein the flaps of the tray are glued to the flaps of the carton; and a locking member that secures the spout in a predetermined position within the carton interior space, the member being in abutment with the neck and positioned between the external collar and the tray, wherein one of the major flaps of the carton comprises a removable sub-panel that enables a user to access the dispensing spout positioned within the interior space of the carton.

11. The container of claim 10, wherein one of the major flaps of the carton comprises a sub-flap that can be folded to provide a handle with which the container can be carried.

12. The container of claim 10, wherein the carton and the support tray are constructed of corrugated fiberboard.

13. A method for supplying printer ink, the method comprising:

filling a fluid containment bag with ink;

positioning a dispensing spout of the bag through an opening within a body of a support tray having flaps;

positioning the bag and the support tray within a corrugated fiberboard carton having major and minor flaps;

folding the flaps of the support tray such that the flaps of the support tray extend parallel to the body of the support tray;

bonding the flaps of the support tray to and sandwiched between the major and minor flaps of the carton; and securing the dispensing spout of the bag in a predetermined positioned within an interior space of the carton using a locking member that contacts a neck of the spout.

14. The container of claim 10, wherein the major flaps of the support bag are glued to and sandwiched between the minor and major flaps of the carton.

15. The container of claim 14, wherein the other of the major flaps of the support tray comprises a first arm glued to a first one of the minor flaps of the carton and a second arm glued to a second one of the minor flaps of the carton.

16. The container of claim 15, wherein one of a major flaps of the support tray is glued to both minor flaps of the carton.

17. The container of claim 1, wherein one of a major flaps of the support tray is glued to both minor flaps of the carton.

18. The container of claim 17, wherein the other of the major flaps of the support tray comprises a first arm glued to a first one of the minor flaps of the carton and a second arm glued to a second one of the minor flaps of the carton.

19. A bag-in-box container for supplying ink to a printer, the container comprising:

a fluid containment bag including a pliable body and a dispensing spout that extends from the body, the spout including an external collar that extends outward from the neck outside of the body and an internal collar that extends outward from the neck inside of the body;

a carton in which the bag is positioned, the spout of the bag being recessed within an interior space of the carton, wherein the carton comprises minor and major flaps that extend from an end of the carton, the minor flaps being shorter than the major flaps;

a support tray positioned between the external and internal collars of the spout, the tray including a body having an opening through which the spout extends, wherein the support tray comprises minor and major flaps that extend out from the body, the minor flaps being shorter than the major flaps, wherein the flaps of the tray are glued to the flaps of the carton; and a locking member that secures the spout in a predetermined position within the carton interior space, the member being in abutment with the neck and positioned between the external collar and the tray, wherein one of the major flaps of the carton comprises a sub-flap that can be folded to provide a handle with which the container can be carried.

20. A bag-in-box container for supplying ink to a printer, the container comprising:

a fluid containment bag including a pliable body and a dispensing spout that extends from the body, the spout including an external collar that extends outward from the neck outside of the body and an internal collar that extends outward from the neck inside of the body;

a carton in which the bag is positioned, the spout of the bag being recessed within an interior space of the carton, wherein the carton comprises minor and major flaps that extend from an end of the carton, the minor flaps being shorter than the major flaps;

a support tray positioned between the external and internal collars of the spout, the tray including a body having an opening through which the spout extends, wherein the support tray comprises minor and major flaps that extend out from the body, the minor flaps being shorter than the major flaps, wherein the flaps of the tray are glued to the flaps of the carton; and a locking member that secures the spout in a predetermined position within the carton interior space, the member being in abutment with the neck and positioned between the external collar and the tray, wherein the major flaps of the support bag are glued to and sandwiched between the minor and major flaps of the carton.

21. The container of claim 20, wherein the other of the major flaps of the support tray comprises a first arm glued to a first one of the minor flaps of the carton and a second arm glued to a second one of the minor flaps of the carton.

22. The container of claim 21, wherein one of a major flaps of the support tray is glued to both minor flaps of the carton.

* * * * *